US006814629B1

(12) United States Patent
Donfrancesco et al.

(10) Patent No.: US 6,814,629 B1
(45) Date of Patent: Nov. 9, 2004

(54) TERMINAL SYSTEM WITH DEFORMED SCREW

(75) Inventors: Angelo T. Donfrancesco, Shelton, CT (US); Nelson Bonilla, West Haven, CT (US)

(73) Assignee: Hubbell Incorporated, Orange, CT (US)

( * ) Notice: Subject to any disclaimer, the term of this patent is extended or adjusted under 35 U.S.C. 154(b) by 451 days.

(21) Appl. No.: 09/105,150

(22) Filed: Jun. 26, 1998

(51) Int. Cl.[7] ..... H01R 11/01
(52) U.S. Cl. ..... 439/782; 411/333
(58) Field of Search ..... 439/801, 813, 439/782, 781, 814, 595, 416, 752, 415, 411–413, 598, 431, 872, 1; 411/257, 271, 325, 309–311, 333

(56) References Cited

U.S. PATENT DOCUMENTS

| | | | | | |
|---|---|---|---|---|---|
| 3,068,445 | A | * | 12/1962 | Crowther | 439/781 |
| 3,205,473 | A | * | 9/1965 | Crowther | 439/781 |
| 3,340,497 | A | * | 9/1967 | Balint | 439/801 |
| 3,736,741 | A | * | 6/1973 | Paratte | 58/23 BA |
| 5,181,310 | A | * | 1/1993 | Josephson | 411/333 |

* cited by examiner

*Primary Examiner*—R. Austin Bradley
*Assistant Examiner*—Felix O. Figueroa

(57) ABSTRACT

A screw terminal assembly for a wiring device includes a terminal base with a bore having an internal thread. A screw having a shank with an internal thread and a head at one end is threadedly engaged in the bore. A portion of the external thread is deformed adjacent the end remote from the head to limit removal of the screw from the bore.

12 Claims, 1 Drawing Sheet

TERMINAL SYSTEM WITH DEFORMED SCREW

FIELD OF THE INVENTION

The present invention relates to a terminal assembly having an externally threaded screw engaged within an internally threaded bore of a terminal, with the screw thread being deformed adjacent to an end remote from the screw head. The deformation acts as a,stop to limit removal of the screw from the terminal bore. Additionally, the present invention relates to a method of forming the terminal assembly.

BACKGROUND OF THE INVENTION

Wiring for industrial, residential, commercial and other applications for providing access to and controlling the provision of electrical power includes such wiring devices as plugs, receptacles and switches. The various wiring devices are connected by insulated copper wires. The wires are connected to the wiring devices by screw terminals mounted on the wiring devices.

Each screw terminal includes a terminal base having an internally threaded bore and a screw having a shank with an external thread and a head on one end of the shank. The screw shank is threaded into the bore, with a portion of the threaded screw shank extending beyond the end of the bore remote from the screw head. The copper wire ends are secured to the terminal by being located between the terminal base and the underside of the screw head, and are then secured in place by tightening the screw head against the conductor to trap the conductor between the terminal base and the screw head.

To enhance this connection, a backing plate is often provided between the screw head and the terminal base. The backing plate has an opening through which the screw shank extends, and has depending tabs which engage slidably within openings in the terminal base. When backing plates are used, the conductors are located between the backing plates and the terminal bases. With rotation of the backing plates being prevented by the engagement of the backing plate tabs and the terminal base openings, the conductors are compressed without the application of torque resulting from the threading of the screw into the terminal base bore.

When the wiring devices are sold or provided for installation, the screws are backed out of or unthreaded to a predetermined degree in the terminal base bores to provide adequate space between the screw head and the terminal base or between the backing plate and the terminal base to readily receive the conductor without having to unthread the screws. The installer then need only tighten the screws after placing the conductor in the appropriate location to secure the conductor in place to the wiring device.

However, conventional terminal assemblies for wiring devices do not have means for fixing the amount of backout or unthreading of the screws. Without a means for fixing this amount, the screws can be threaded too far into or out of the terminal base bore. If the screws are threaded too far into the terminal base bore, inadequate space is provided for the conductor, requiring the installer to back the screw out of the terminal base. This action requires additional effort by the installer and increases the possibility of the screw becoming removed from the wiring device and becoming lost. Additionally, if the screw is not adequately threaded into the terminal base, the screw can become disconnected from the wiring device and lost.

SUMMARY OF THE INVENTION

An object of the present invention is to provide a terminal assembly for a wiring device that enables the screw to be backed out to a predetermined dimension according to a relatively tight tolerance.

Another object of the present invention is to provide a screw terminal which allows the screw to be backed out from the terminal base to its maximum capacity without becoming disengaged, and which is inexpensive and of rugged construction.

A further object of the present invention is to provide a method of making a terminal assembly which is easy to manufacture and provides a terminal assembly which is inexpensive and of rugged construction.

The foregoing objections are obtained by a terminal assembly comprising a terminal base and a screw. The terminal base has a bore with an internal thread. The screw has a shank with opposite first and second ends and with an external thread, and has a head on the first end of the shank. A deformation is provided in a portion of the external thread adjacent the shank second end.

By forming the terminal assembly in this manner, the deformation acts as a stop to limit the degree of removal of the screw from the bore in the terminal base. This allows the backout of the screw to be set to a predetermined dimension with a relatively high tolerance. Additionally, the screw can be backed out to its maximum extent without it becoming disengaged from the terminal base since the deformation prevents unthreading beyond the deformation.

In a particularly advantageous embodiment of the invention, the deformation is formed by a stake in the shank second end. The stake forms the deformation and can be easily formed after the screw is located within the terminal base bore.

The foregoing objects are also basically obtained by a method of forming a terminal assembly comprising the steps of threading an external thread of a shank of a screw into an internally threaded bore in a terminal base. The shank has opposite first and second ends with a head on its first end. A portion of the external thread is deformed adjacent the second end of the shank to limit the amount the screw can be backed out of the bore, after the screw had been threaded into the bore.

Other objects, advantages and salient features of the present invention will become apparent from the following detailed description, which, taken in conjunction with the annexed drawings, discloses preferred embodiments of the invention.

BRIEF DESCRIPTION OF THE DRAWINGS

Referring to the drawings which form a part of this disclosure.

DETAILED DESCRIPTION OF THE PREFERRED EMBODIMENTS

Figure 1:
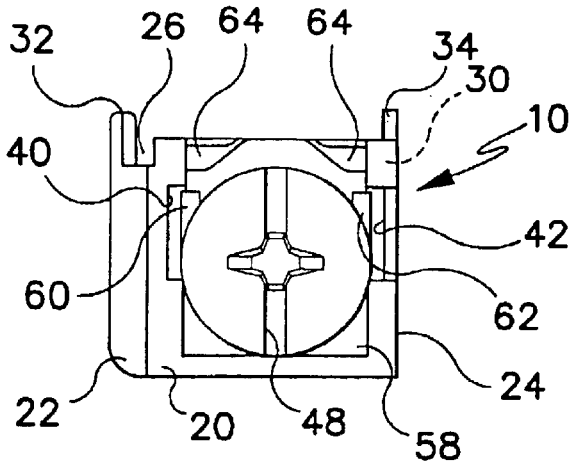
FIG. 1 is a top plan view of a terminal assembly according to a first embodiment of the present invention.

Referring initially to the first embodiment of the present invention illustrated in FIGS. 1–4, terminal assembly 10 comprises a terminal base 12, a screw 14 and a backing plate 16. Screw 14 is threadedly engaged with the terminal base 12. Backing plate 16 is mounted on the screw and can be forced by the screw in the direction of the terminal base to compress a conductor therebetween. A deformation 18 in a portion of the screw thread, adjacent its end remote from the screw head, limits removal of the screw from the terminal base.

Terminal base 12 is conventional and comprises a substantially planar base plate 20 which is generally rectangular in configuration. The terminal base is formed of electrically conductive metal. Depending flanges 22 and 24 extend from opposite side edges of the base plate 20. Flange 22 extends at an obtuse angle relative to the base plate and has an undercut 26. Flange 24 has undercuts 28 and 30. Each of the flanges has a protrusion 32 or 34 extending parallel and in the same direction from the respective flange. Flanges 22 and 24 secure the terminal base to a wiring device and provide electrical connection to the internal electrically conductive portions of the wiring device. The central portion of base plate 20 has a depending cylindrical portion 36 which defines a bore 38. Bore 38 has an internal thread 39. Adjacent the opposite sides of base plate 20, elongated openings 40 and 42 are provided.

Screw 14 comprises a shank 44 with a head 46 at one end of the shank. The head is of conventional design with a screw driver receiving slot 48. Shank 44 has an external thread 50 which extends substantially its entire length form its adjacent head 46 to its opposite end 52. Thread 50 mates with internal thread 39 in bore 38.

The axial length of external thread 50 is substantially greater than the axial length of internal thread 39 in bore 38 to permit the head to be located at various desired distances from base plate 20, while the two threads are engaged. End 52 of shank 44 is circular.

A stake 54 is formed in shank end 52, extends along a chord of that circular end, and is laterally spaced or offset from the longitudinal axis of the screw. The stake creates a deformed portion or deformation 56 in the external thread having a reduced width between adjacent crests of the external thread, relative to other portions of the external thread. This deformed portion or deformation in the screw external thread forms a stop which does not threadedly mate with internal thread 39 in bore 38. In this manner, the deformed portion limits the removal of the screw from the bore.

Backing plate 16, like terminal base 12, is of conventional construction, and thus, is only described generally. Backing plate 16 comprises a plate member 58 of generally rectangular configuration. Tabs 60 and 62 depend from opposite side edges of plate member 56, and mate with and are received within terminal base openings 40 and 42. Engagement of the terminal base openings with the tabs restrictions rotation of the backing plate. One edge of the backing plate includes flared portions 64 which facilitate the introduction of electrical conductors between base plate 20 and plate member 58. Additionally, plate member 58 has a central aperture 66. Aperture 66 is circular and has a diameter somewhat larger than the crest diameter of external thread 50 on screw shank 44 to allow the screw to readily pass therethrough and to rotate relative to it.

The terminal assembly is formed by initially attaching the conventional terminal base 12 and backing plate 14 with tabs 60 and 62 received in openings 40 and 42. A screw, without stake 54, is then threaded into bore 38 to a point of its maximum backout dimension. Such backout dimension corresponds to a spacing between head 46 and base plate 20 which allows tabs 60 and 62 to at least be partially received within openings 40 and 42 to restrain rotation of the backing plate relative to the terminal base. In this position, stake 54 is then formed by punching in end 52 of shank 44. The formation of the stake 54 creates deformation or deformed portion 56 in external thread 50 to limit the amount the screw can be backed out of the terminal base bore.

Figure 5:
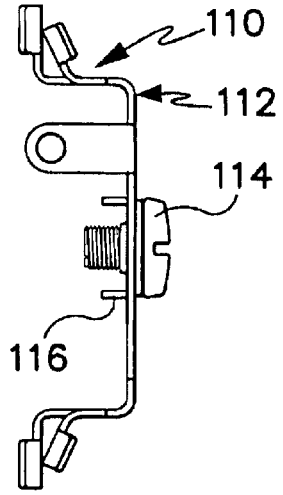
FIG. 5 is a side elevational view of a terminal assembly according to a second embodiment of the present invention.

FIG. 5 illustrates a terminal assembly 110 according to a second embodiment of the present invention. Terminal assembly 110 comprises a terminal base 112, a screw 114 and a backing plate 116. Screw 114 land backing plate 116 are identical in configuration to screw 14 and backing plate 16 of the first embodiment, respectively, and thus, need not be described further.

Terminal base 112 is of a conventional configuration suitable for use in an electrical receptacle. Since the form of this terminal assembly is conventional, it is not described further herein.

Figure 2:
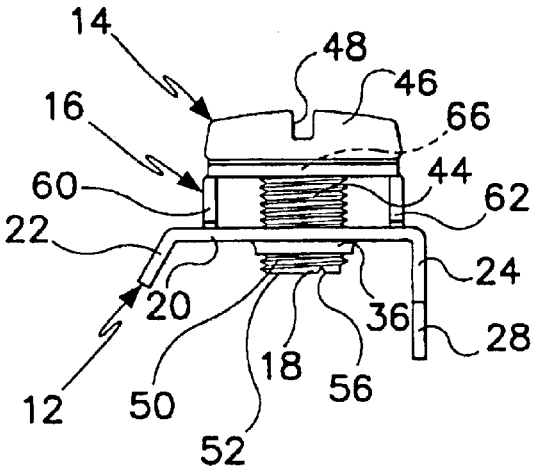
FIG. 2 is a side elevational view of the terminal assembly of FIG. 1.
Figure 3:
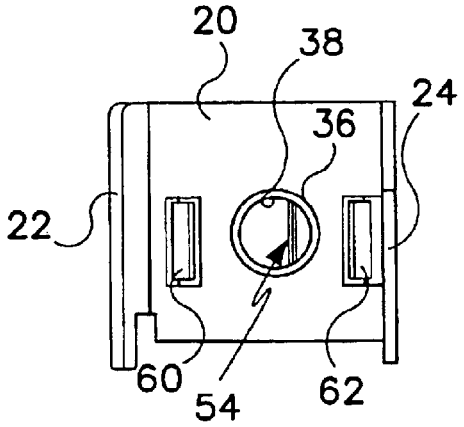
FIG. 3 is a bottom plan view of the terminal assembly of FIG. 1.
Figure 4:
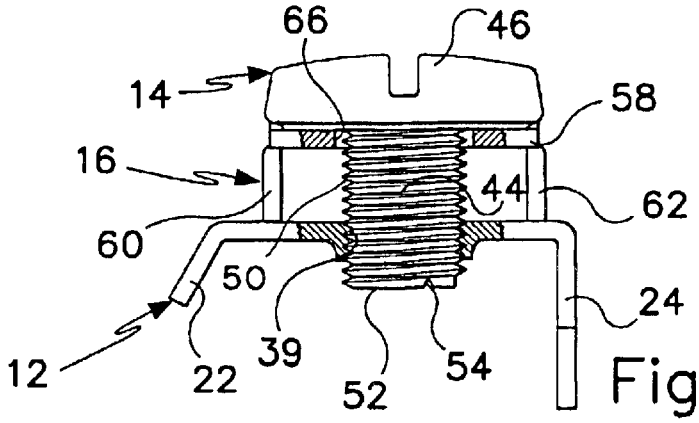
FIG. 4 is an enlarged side elevational view, partially in section, of the terminal assembly of FIG. 1.

FIG. 5 illustrates the screw in the fully inserted position within the terminal base bore. In contrast, FIG. 2 illustrates the screw in its maximum backed out position.

While various embodiments have been chosen to illustrate the invention, it will be understood by those skilled in the art that various changes and modifications can be made therein without departing from the scope of the invention as defined in the appended claims.

What is claimed is:

1. A terminal assembly, comprising:

a terminal base having a bore with a internal thread;

a screw having a shank with opposite first and second ends and with an external thread, and having a head on said first end of said shank, said second end of said shank being circular and substantially planar; and a deformation in a portion of said external thread adjacent said second end of said shank, said deformation being a stake formed in said second end of said shank and extending along a chord of said second end transverse to the longitudinal axis of the shank;

whereby said deformation limits removal of said screw from said bore wherein said portion of said external thread forming said deformation has a reduced width between adjacent crests thereof relative to other portions of said external thread.

2. A terminal assembly according to claim 1 wherein said stake is offset from and extends perpendicular to the longitudinal axis of said shank.

3. A terminal assembly according to claim 1 wherein a backing plate has a central aperture receiving said shank and is positional between said head and said terminal.

4. A terminal assembly according to claim 3 wherein said backing plate comprises a depending tab; and said terminal base comprises an opening slidably receiving said tab.

5. A terminal assembly according to claim 3 wherein said backing plate comprises depending first and second tabs on opposite side edges thereof; and said terminal base comprises first and second openings slidably receiving said first and second tabs, respectively.

6. A terminal assembly according to claim 1 wherein said terminal base comprises a contact extending therefrom.

7. A terminal assembly according to claim 1 wherein said external thread has an axial length sustaining greater than an axial length of said internal thread.

8. A terminal assembly, comprising:

a terminal having a base plate including a bore with an internal thread of a first axial length;

a screw having a shank with opposite first and second ends and with an external thread of a second axial length threadedly mating with said internal thread, and having a head on said first end of said shank, said second end of said shank being planar and circular, said second axial length being substantially greater than said first axial length; and a stake formed in and extending along a chord of said second end transverse to the longitudinal axis of said shank, said stake creating a deformed portion of said external thread having a reduced width between adjacent crests thereof relative to other portions of said external thread, said deformed portion of said external thread forming a stop which does not threadedly mate with said internal thread.

9. A terminal assembly according to claim 8 wherein a backing plate has a central aperture receiving said shank and is positional between said head and said terminal.

10. A terminal assembly according to claim 9 wherein said backing plate comprises a depending tab; and said terminal base comprises an opening slidably receiving said tab.

11. A terminal assembly according to claim 9 wherein said backing plate comprises depending first and second tabs on opposite side edges thereof; and said terminal base comprises first and second openings slidably receiving said first and second tabs, respectively.

12. A terminal assembly according to claim 8 wherein said terminal comprises a contact extending from said base plate.

* * * * *